United States Patent [19]

Hinz

[11] Patent Number: 4,967,653

[45] Date of Patent: Nov. 6, 1990

[54] CALENDER HAVING DISPLACEABLE BEARING PARTS

[75] Inventor: Joachim Hinz, Tettnang, Fed. Rep. of Germany

[73] Assignee: Sulzer Escher Wyss, Ravensburg, Fed. Rep. of Germany

[21] Appl. No.: 290,417

[22] PCT Filed: Mar. 8, 1988

[86] PCT No.: PCT/DE88/00126

§ 371 Date: Dec. 12, 1988

§ 102(e) Date: Dec. 12, 1988

[87] PCT Pub. No.: WO88/08467

PCT Pub. Date: Nov. 3, 1988

[30] Foreign Application Priority Data

Apr. 23, 1987 [DE] Fed. Rep. of Germany ..... 3713560

[51] Int. Cl.[5] ..... B30B 3/04

[52] U.S. Cl. ..... 100/168; 100/163 A; 100/169

[58] Field of Search ..... 100/47, 162 R, 163 R, 100/163 A, 168, 169

[56] References Cited

U.S. PATENT DOCUMENTS

| | | | |
|---|---|---|---|
| 3,364,848 | 1/1968 | Muller | 100/163 R X |
| 3,777,656 | 12/1973 | Muller | 100/163 A X |
| 3,867,879 | 2/1975 | Schlunke et al. | 100/162 R |
| 4,290,351 | 9/1981 | Pay et al. | 100/163 A X |
| 4,347,784 | 9/1982 | Pav et al. | 100/162 R |
| 4,510,859 | 4/1985 | Berry | 100/162 R X |
| 4,736,678 | 4/1982 | Stotz | 100/168 X |

FOREIGN PATENT DOCUMENTS

| | | |
|---|---|---|
| 1931385 | 2/1970 | Fed. Rep. of Germany . |
| 2224875 | 12/1973 | Fed. Rep. of Germany . |
| 2423504 | 11/1975 | Fed. Rep. of Germany . |

*Primary Examiner*—Frankie L. Stinson

*Attorney, Agent, or Firm*—Werner W. Kleeman

[57] ABSTRACT

Support of a nip relieving device to compensate for overhanging weights at an elevationally displaceable bearing part of an intermediate roll of the calender is effected relative to the stand of the calender by an elevationally displaceable support member. This support member is displaceable by a threaded spindle which is rotatable with a motor and gearing and supported by the stand, to which threaded spindle the support member is individually engageable. The support member is thus individually displaceable to the related bearing part, according to the elevational position thereof, into a desired relative position. According to a preferred embodiment, the components of the nip relieving device are arranged in a bearing sleeve enclosing the threaded spindle and the support member is formed by a nut which is elevationally displaceable by rotation of the threaded spindle.

5 Claims, 1 Drawing Sheet

CALENDER HAVING DISPLACEABLE BEARING PARTS

BACKGROUND OF THE INVENTION

The present invention relates to a new and improved construction of a calender having displaceable bearing parts.

In its more particular aspects, the present invention relates to a new and improved construction of a calender having displaceable bearing parts and intermediate rolls which are arranged between an uppermost roll and a lowermost roll and supported at their respective axles. The displaceable bearing parts are secured at one side of nip-relieving devices having an other side which is upported at an elevationally displaceable support member which is suspended at a stand. A slide guide is provided for elevationally displacing the bearing parts in the stand by means of bearing part portions which are adapted to the slide guide.

Such calenders are used, for example, in the paper industry for processing or refining paper webs. The calenders comprise a number of intermediate rolls which are arranged between an uppermost roll and a lowermost roll and can be pressed together by these uppermost and lowermost rolls. As a result, a pressure builds up between the rolls of the calender. Efforts are made to have, between the individual rolls, gaps, the so-called nips, possessing as far as possible the same clearance across the entire width of the nip. As is well known, this is adversely influenced by so-called overhanging weights which act upon each roll on both sides thereof in the downward direction. It is known to arrange nip relieving devices between the roll and the stand of the calender in order to compensate for the overhanging weights. In a known calender which, for example, is known from the European Patent Application No. 86116695.7 (W.G. Stotz), published Aug. 5, 1987 (Publication No. 0,230,563) and cognate with U.S. Pat. No. 4,736,678, granted Apr. 12, 1988, the nip relieving devices are hydraulic cylinder-and-piston motors by means of which a force is adjustable, which force acts against the force of the overhanging weights. The intermediate rolls are thereby mounted in bearing parts which are elevationally displaceable along a slide guide. Since in this calender the diameter of the individual rolls varies owing to wear of the surface thereof, the rolls are at times in a different elevational position. Such changes must be pursued also by the nip relieving device. Normally, the support members for the nip relieving devices are elevationally displaceably arranged at the stand. The main problem of the hitherto existing constructions results from the limited space which is available for the nip relieving devices between the individual rolls to be supported.

SUMMARY OF THE INVENTION

Therefore, with the foregoing in mind it is a primary object of the present invention to provide a new and improved construction of a calender having displaceable bearing parts and which calender is not afflicted with the drawbacks and limitations of the prior art constructions heretofore discussed.

It is an important object of the present invention to provide a new and improved construction of a calender having displaceable bearing parts in which calender the nip relieving device and the displaceable support member are constructed in a manner which permits their use under the limited space conditions available in such calenders.

A further significant object of the present invention is directed to the provision of a new and improved construction of a calender having displaceable bearing parts and in which comparatively simple control means are employed for controlling the operation of the nip relieving device and the displaceable support member under the existing limited space conditions of such calenders.

Another noteworthy object of the present invention aims at providing a new and improved construction of a calender having displaceable bearing parts and containing displacement means which are constructed to render possible retrofitting existing calenders with the inventive construction.

Still a quite significant object of the present invention is directed to a new and improved construction of a calender of the initially mentioned type containing displacement means which are relatively simple in construction and design, economical to manufacture, highly reliable in operation, not readily subject to breakdown or malfunction and require a minimum of maintenance and servicing.

Now in order to implement these and still further objects of the invention, which will become more readily apparent as the description proceeds, the calender of the present development is manifested, among other things, by the features that, the nip relieving device is supported at the support member which is displaceable by means of a threaded spindle which, in turn, is supported at the stand and can be rotated by means of a drive motor and gearing. The threaded spindle can be individually engaged to the support member which is thereby individually displaceable in relation to the respective bearing part and, according to the elevational position thereof, into a desired relative position.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
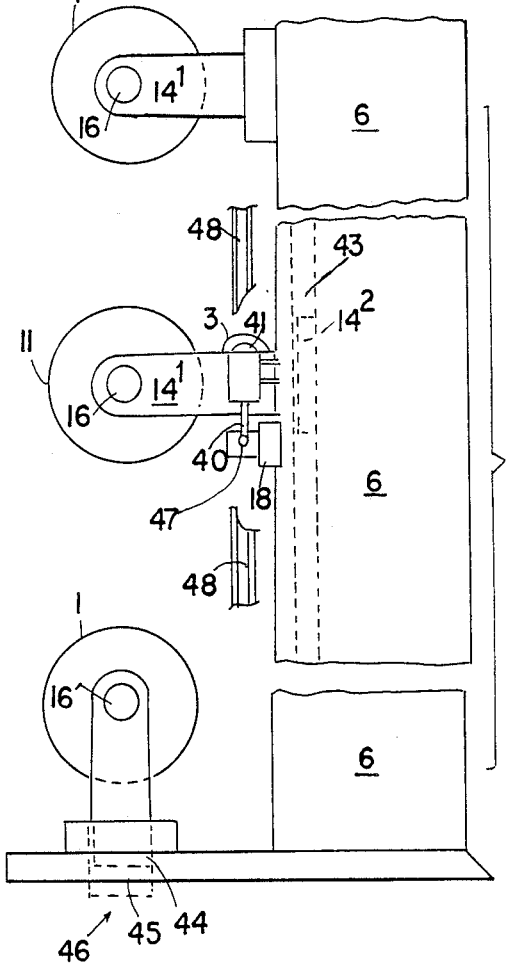
FIG. 1 is a schematic side view of a first exemplary embodiment of the inventive calender.

Describing now the drawings, it is to be understood that only enough of the construction of the calender has been shown as needed for those skilled in the art to readily understand the underlying principles and concepts of the present development, while simplifying the showing of drawing. Turning attention specifically to FIG. 1 of the drawings, the calender illustrated therein by way of example and not limitation will be seen to comprise displaceable bearing parts 14[1] which are constructed in adaptation to the limited space conditions available in such calenders.

A bearing part $14^1$, in which an intermediate roll 11 with its axle 16 is rotatably mounted, is elevationally displaceable in a slide guide 43 provided in the stand 6 by means of a portion $14^2$ which is structured for this purpose. To compensate for the overhanging weights, one side of the nip relieving device 3 is secured at the bearing part $14^1$. In the embodiment in FIG. 1, it is a hydraulic cylinder-and-piston unit, the piston rod 40 of which, i.e. the second side of the device 3, is supported at the point 47 at a support member 18. This support member is slidable at the stand 6, arranged parallel to the slide guide 43 and suspended at a threaded spindle 48. This threaded spindle extends parallel to the slide guide 43, is supported by the frame 6 and rotatable by means of a not shown motor and gearing which are also mounted at the stand or frame 6. Each support member 18 is individually engageable to this threaded spindle 48, so that the support member 18 can be individually displaced relative to the related bearing part $14^1$ and, according to the given elevational position of the bearing part $14^1$, into a desired relative position to the bearing part. This relative position brings the piston of the device 3 into a median or mean position in the cylinder space of the device, as is required by the given stroke of the piston in the cylinder, in order to be able to follow the holding, raising and lowering of the bearing part $14^1$.

Figure 2:
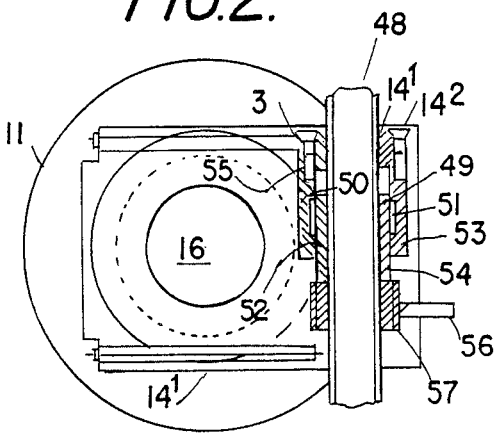
FIG. 2 shows a partially sectional view of a nip relieving device in a preferred embodiment of the calender according to the invention; partially in section.
Figure 3:
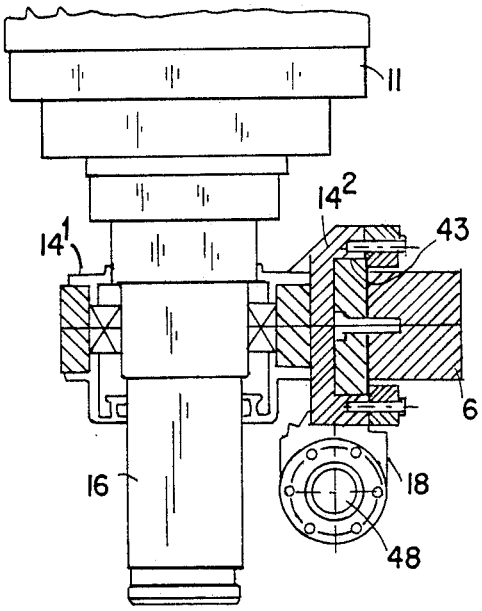
FIG. 3 shows a view of the nip relieving device in the direction of the arrow A in FIG. 2.

In a preferred embodiment which is particularly clearly depicted in FIGS. 2 and 3, the support member is constructed as a nut 57 which is displaceable parallel to the slide guide 43 by means of rotation of the threaded spindle 48.

The nip relieving device 3 comprises a bearing sleeve 50 which encloses the threaded spindle 48. The threaded spindle 48 extends non-contactingly through the bearing sleeve 50. As shown, the bearing sleeve 50 mounted at the bearing part $14^1$ is screwed on. Within the bearing sleeve 50 there is provided a cylinder space which is structured to accommodate an annular piston 52 which delimits in the cylinder space an upper space 51 and a lower space 53. The annular piston 52 is provided with a supporting part 54 directed downwardly and acting as a piston rod, so that the annular piston 52, with it the bearing sleeve 50 and the bearing part $14^1$ via such bearing sleeve, can be supported at the nut 57, which here represents the support member for the nip relieving device 3.

In order to bring about the displacement of the nut 57 along the threaded spindle 48, the rotation of the nut 57 conjointly with the threaded spindle 48 must be prevented. This is done by means of a stopping device 56 which is supported at the bearing part $14^1$. In this manner, the rotation of the nut 57 is arrested such that the nut 57 is displaced along the threaded spindle 48 during rotation of the latter.

The displacement of the nut 57 is also possible in that, for example, the threaded spindle 48 is guided in a nut at the stand 6. The threaded spindle moves upward and downward during rotation thereof. When the stopping device or latch 56 is disengaged, the nut 57 moves upward and downward with the threaded spindle 48.

According to the preferred embodiment, the nut 57 is an externally toothed wheel having an axis-parallel toothing, into which toothing a pneumatically controlled stopping device or latch 56 engages, in order to prevent the rotation of the nut 57. The displacement of the nut 57 with respect to the stopping device or latch 56 is naturally possible solely across the length of the external toothing. This has to be considered in conjunction with the construction of the nut 57.

The nip relieving device 3 functions as follows: During the so-called closing of the calender, the intermediate rolls 11 are brought into their operating position owing to lifting by means of the lowermost roll. During opening of the spaces 51 and 53, the nut 57 is moved to a desired relative position with respect to the lower edge of the bearing sleeve 50. By filling the upper space 51 with pressure fluid, the annular piston 52 is displaced downward, so that the supporting part 54 comes to bear upon the nut 57. The pressure in the space 51 generates the force which is required to compensate for the overhanging weights. When the calender is opened by lowering the lowermost roll 1, the upper space 51 is opened, so that the annular piston 52 moves upward with the supporting part 54 and the bearing part $14^1$ descends until the lower edge of the bearing sleeve 50 comes to seat upon the nut 57. This operation during rapid opening of the calender can be accelerated in that the lower space 53 is rapidly filled with pressure fluid. When then later on the upper space 51 has to be placed under pressure, the lower space 53 must be opened and emptied.

The set distance between the lower edge of the bearing sleeve 50 and the nut 57 determines the path through which the individual intermediate roll 11 falls downward during opening of the calender from the instantaneous working position thereof into the opened position. Naturally, this set distance is also the path which the bearing part $14^1$, in which the roll is mounted, travels through during the opening of the calender. This distance is the smallest at the second-uppermost intermediate roll 11 of the calender and successively always larger at the lower intermediate rolls 11, until the distance is the largest at the second-lowermost intermediate roll 11. In this manner, the gaps between the individual rolls of the calender can have a uniform clearance.

The subject matter of the invention is not limited only to the application in bearing parts displaceable in the frame. It is evident that a nip relieving device according to the invention with threaded spindle and supporting nut can also be used in a calender in which the individual intermediate rolls are mounted at levers pendulously arranged at the frame and elevationally displaceable.

While there are shown and described present preferred embodiments of the invention, it is to be distinctly understood that the invention is not limited thereto, but namely otherwise variously embodied and practiced within the scope of the following claims. Accordingly,

What I claim is:

1. A calender containing an uppermost roll, a lowermost roll and at least one intermediate roll having at opposite ends thereof respective bearing parts which are elevationally displaceably guided at a stand of the calender, comprising:

a threaded spindle rotatable about its axis and extending along said stand;

nip relieving means for relieving an associated one of the bearing parts from an overhanging weight at the associated one of the opposite ends of the at lest one intermediate roll;

said nip relieving means containing a bearing sleeve mounted at said associated bearing part;

said bearing sleeve enclosing an associated portion of said rotatable threaded spindle;

said nip relieving means further containing an annular piston which is located within said bearing sleeve substantially coaxial with respect to said associated portion of the rotatable threaded spindle;

said annular piston conjointly with said bearing sleeve defining an annular space subjectable to fluid pressure sufficient to compensate for the overhanging weight at the associated end of the at least one intermediate roll;

said annular piston being connected to a supporting arm which extends through said bearing sleeve;

a support member for supporting said supporting arm of said annular piston of said nip relieving means;

said support member constituting a nut threadably engaged with said rotatable threaded spindle; and arresting means for arresting aid nut relative to said rotatable threaded spindle in order to permit elevational adjustment of said nut and thereby said annular piston of said nip relieving means upon rotation of said threaded spindle about its axis.

2. The calender as defined in claim 1, wherein:

said arresting means constitute a stopping device mounted at said associated bearing part.

3. The calender as defined in claim 2, wherein:

said nut is constructed as a toothed wheel having an axis and external toothing extending substantially parallel to said axis; and said stopping device constituting a latch for arresting said toothed wheel relative to said rotatable threaded spindle.

4. The calender as defined in claim 3, wherein:

said latch is pneumatically engageable to said toothed wheel.

5. The calender as defined in claim 1, wherein:

said rotatable threaded spindle is displaceable along said stand of said calender.

* * * * *